US011272819B2

(12) United States Patent
Drivstuen et al.

(10) Patent No.: US 11,272,819 B2
(45) Date of Patent: Mar. 15, 2022

(54) HOSE VALVE SUB-ASSEMBLY APPARATUS AND METHOD FOR RETRACTABLE HOSE VACUUM SYSTEMS

(71) Applicants: Rod Drivstuen, Monroe, WA (US); Robert Lee Rawls, Woodinville, WA (US)

(72) Inventors: Rod Drivstuen, Monroe, WA (US); Robert Lee Rawls, Woodinville, WA (US)

( * ) Notice: Subject to any disclaimer, the term of this patent is extended or adjusted under 35 U.S.C. 154(b) by 415 days.

(21) Appl. No.: 16/430,752

(22) Filed: Jun. 4, 2019

(65) Prior Publication Data

US 2019/0365175 A1 Dec. 5, 2019

Related U.S. Application Data

(60) Provisional application No. 62/680,463, filed on Jun. 4, 2018.

(51) Int. Cl.

| | |
|---|---|
| ***A47L 9/24*** | (2006.01) |
| ***A47L 5/38*** | (2006.01) |
| *A47L 9/02* | (2006.01) |

(52) U.S. Cl.

CPC ..... *A47L 9/242* (2013.01); *A47L 5/38* (2013.01); *A47L 9/02* (2013.01)

(58) Field of Classification Search

CPC ... A47L 5/38; A47L 9/02; A47L 9/242; A47L 9/244

See application file for complete search history.

(56) References Cited

U.S. PATENT DOCUMENTS 2,953,806 A * 9/1960 Walker ..... A47L 5/38 15/315
3,146,483 A * 9/1964 Bishop ..... A47L 5/38 15/314

(Continued)

FOREIGN PATENT DOCUMENTS

CA 880976 9/1971
CA 881627 9/1972

(Continued)

*Primary Examiner* — Marc Carlson
(74) *Attorney, Agent, or Firm* — William Forster

(57) ABSTRACT

A hose valve sub-assembly designed for use in central vacuum cleaning systems that include a retractable suction hose. The hose valve sub-assembly comprises an end nozzle arranged for attachment with the end of a suction hose and a seal-ring arranged for attachment to a valve box. The seal-ring defines a radially disposed inner surface for receiving and engaging the end nozzle and comprises a radially biased pin for locking the end nozzle the seal-ring. The end nozzle comprises a radially disposed O-ring groove arranged to receive an O-ring for sealing the end nozzle to the inner surface of the seal-ring. The end nozzle also comprises a radially disposed locking track having a first end that defines a first opening arranged to receive and engage the biased pin of the seal ring when the suction hose is pulled through the system vacuum pipe. The locking track includes an opposing second end that defines a second opening arranged to receive the biased pin of the seal ring when the vacuum suction hose is inserted through the valve box, into the seal-ring. With this configuration, the end nozzle is rotatable from a first disengaged position where the biased pin is adjacent one of the two openings, to a second locked position where the biased pin is in the locking track of the end nozzle, between the first opening and second opening.

19 Claims, 7 Drawing Sheets

(56) References Cited

U.S. PATENT DOCUMENTS 3,283,093 A * 11/1966 Bishop ..... A47L 5/38 15/301
3,565,103 A * 2/1971 Maselek ..... A47L 5/38 137/360
3,593,363 A * 7/1971 Hamrick ..... A47L 9/244 15/315
4,634,197 A * 1/1987 Horlacher, Jr. ..... H01R 31/06 439/192
4,664,457 A * 5/1987 Suchy ..... H01R 24/76 439/142
4,758,170 A * 7/1988 Hayden ..... A47L 5/38 439/142
4,846,712 A * 7/1989 Holden ..... H01R 4/2454 439/191
4,894,020 A * 1/1990 Holden ..... A47L 9/246 29/857
4,895,528 A * 1/1990 Choiniere ..... A47L 5/38 439/171
5,069,635 A * 12/1991 Holden ..... H01R 4/2454 439/400
5,349,146 A * 9/1994 Radabaugh ..... A47L 5/38 15/314
5,430,978 A * 7/1995 Kohler ..... A47L 5/38 248/95
5,448,827 A * 9/1995 Ward ..... A47L 5/38 174/47
5,526,842 A * 6/1996 Christensen ..... A47L 5/38 137/355.16
5,578,795 A * 11/1996 Ward ..... A47L 5/38 15/314
5,740,581 A * 4/1998 Harrelson, II ..... A47L 5/38 137/355.16
5,740,582 A * 4/1998 Harrelson, II ..... A47L 5/38 137/355.16
6,143,996 A * 11/2000 Skanda ..... A47L 5/38 200/61.6
6,158,080 A * 12/2000 Schlapkohl ..... A47L 5/38 15/301
6,182,327 B1 * 2/2001 Gosselin ..... A47L 5/38 137/355.16
7,010,829 B2 * 3/2006 Harman ..... A47L 5/38 15/314
7,226,302 B2 * 6/2007 Walter ..... A47L 9/246 439/191
8,001,650 B2 8/2011 Trotter
8,479,353 B2 * 7/2013 Drivstuen ..... A47L 5/38 15/301
9,717,381 B2 * 8/2017 Harman ..... A47L 5/38
10,010,229 B2 * 7/2018 Drivstuen ..... A47L 5/38
10,292,558 B2 * 5/2019 Graves ..... A47L 9/244
2001/0022009 A1 * 9/2001 Spearman ..... A47L 5/38 15/314
2002/0069477 A1 * 6/2002 Smith ..... A47L 9/28 15/377
2004/0250371 A1 * 12/2004 Ambrose ..... A47L 9/242 15/314
2005/0183228 A1 * 8/2005 Snyder ..... A47L 5/38 15/314
2007/0174991 A1 * 8/2007 Trotter ..... A47L 9/0063 15/314
2008/0092323 A1 * 4/2008 Smith ..... A47L 9/0063 15/314
2010/0024152 A1 * 2/2010 Drivstuen ..... A47L 5/38 15/314
2015/0190023 A1 * 7/2015 Nieschwitz ..... A47L 9/0009 15/315
2016/0367095 A1 * 12/2016 Bruneau ..... A47L 9/242
2017/0127897 A1 * 5/2017 Drivstuen ..... A47L 9/244
2017/0332858 A1 * 11/2017 Nieschwitz ..... A47L 9/2857
2018/0153364 A1 * 6/2018 Nieschwitz ..... A47L 5/38
2019/0274504 A1 * 9/2019 Christensen ..... B65H 75/362
2020/0046186 A1 * 2/2020 Woodbury ..... A01M 3/005
2020/0178745 A1 * 6/2020 Nieschwitz ..... A47L 9/242

FOREIGN PATENT DOCUMENTS

CA 908915 4/2001
CA 2568215 A1 * 12/2004 ..... A47L 5/38
CA 2685122 A1 * 5/2011 ..... A47L 9/246
CA 2778554 A1 * 11/2012 ..... A47L 5/38
CA 2919912 A1 * 4/2017 ..... A47L 9/244
EP 0399991 A1 5/1990
EP 3545808 A1 * 10/2019 ..... A47L 9/242
WO WO0124677 A1 4/2001

* cited by examiner

HOSE VALVE SUB-ASSEMBLY APPARATUS AND METHOD FOR RETRACTABLE HOSE VACUUM SYSTEMS

This application claims the benefit of U.S. Provisional Application No. 62/680,463

BACKGROUND

This invention relates generally to central vacuum cleaning systems, and more particularly to central vacuum cleaning systems comprising retractable suction hoses that retract through a hose valve, into a system vacuum pipe.

Central vacuum cleaning systems are well known and have been available for many years. One early design is U.S. Pat. No. 3,593,363 issued in 1972 disclosing a central vacuum cleaning system using a retractable hose. The inserted end of the hose has a compressible annular seal. The hose is pulled out of the suction conduit located in a wall or floor until the foot end or inserted end reaches the receptacle mounted on the floor or wall, at which time the annular seal on the hose engages a corresponding annular abutment at the receptacle to hold the hose in position and seal between the hose and the receptacle. Accordingly, this design requires that the full length of the hose be pulled out prior to the user using the vacuum.

In 1987, U.S. Pat. No. 4,688,596 issued disclosing a wall outlet box for a control vacuum system that connects to a vacuum hose. The '596 design does not provide any hose storage, or retractable hose features.

In 1990, U.S. Pat. No. 4,895,528 issued disclosing a hose-to-wall fitting for a central vacuum system. Like the earlier '596 reference, the features of the '528 patent were directed to a hose connection fitting only.

Later, in 1996, U.S. Pat. No. 5,526,842 issued to Christensen disclosing a motorized hose wind-up mechanism that requires a somewhat complicated and expensive mechanism for the operation thereof.

In 2013, U.S. Pat. No. 8,479,353 issued to Drivstuen et al disclosing a retractable hose vacuum system that employed a valve box having a rather large door that incorporated a seal around the entire outside perimeter. This design required a large valve box that was difficult to adapt to installations with widely varying wall thicknesses.

While most of the above noted central vacuum system designs include features that are useful in the task to perform the debris vacuum removal process, they typically do not provide a simple, quick way of deploying a long vacuum hose through a compact valve box where the hose can be locked into position when the hose is fully extended, or easily removed from the hose valve assembly.

Accordingly, a need remains for a compact hose valve, for a central vacuum cleaning system, that allows the user to quickly remove the suction hose from the valve box and likewise, to quickly deploy the suction hose into and through the hose valve assembly.

SUMMARY OF THE INVENTION

One object of the present invention is to enable the user to lock the suction vacuum hose in place when the hose is fully extended out from the wall.

A second object is to reduce the size of valve boxes used in vacuum hose systems.

Another object is to reduce the size of a sealing element to prevent the flow of air in to a valve box.

Yet another object is to simplify the mechanism that locks the vacuum hose within the hose valve.

A further object is to stabilize and maintain a deployed vacuum suction hose.

Still another object is to maintain the air seal around a vacuum hose designed to retract in a vacuum system pipe.

An additional object is to reduce the cost of retractable hose vacuum systems.

Another object is to arrange a hose valve to accommodate vacuum suction hoses having a male end nozzle fitting that can be sealed within the hose valve.

The invention is a hose valve sub-assembly designed for use in central vacuum cleaning systems that include a retractable suction hose that retracts through a valve box into a system vacuum pipe. The hose valve sub-assembly comprises an end nozzle arranged for attachment with the end of a vacuum suction hose. The hose valve sub-assembly also includes a seal-ring arranged to be incorporated and positioned within a hose valve. Importantly, the seal-ring defines a radially disposed inner surface for receiving and engaging the end nozzle, wherein the seal-ring comprises a radially biased pin for locking the end nozzle to a position within the seal-ring.

Moreover, the end nozzle comprises a hose engaging end-section for sealed attachment to a suction hose, and an opposing locking end configured to engage the inner surface of the seal-ring. The end nozzle further defines an interior surface radially disposed about a longitudinal axis, wherein the locking end of the end nozzle further defines an exterior surface with a radially disposed O-ring groove arranged to receive an O-ring for sealing the end nozzle to the inner surface of the seal-ring.

The locking end of the end nozzle further comprises an exterior surface that defines a radially disposed locking track having a first end that defines a first opening adjacent the hose engaging end-section. The first opening is arranged to receive and engage the biased pin of the seal-ring when the suction hose is pulled through the system vacuum pipe. In addition, the locking track includes an opposing second end that defines a second opening disposed adjacent the O-ring groove and O-ring. It should be noted that the second opening is arranged to receive the biased pin of the seal-ring when the vacuum suction hose is inserted through the valve box, into the seal-ring. With this configuration, the end nozzle is rotatable from a first disengaged position where the biased pin is adjacent one of the two openings, to a second locked position where the biased pin is in the locking track of the end nozzle, between the first opening and second opening.

The foregoing and other objects, features, and advantages of this invention will become more readily apparent from the following detailed description of a preferred embodiment which proceeds with reference to the accompanying drawings, wherein the preferred embodiment of the invention is shown and described, simply by way of illustration of the best mode contemplated of carrying out the invention. As will be realized, the invention is capable of other and different embodiments, and its several details are capable of modifications in various obvious respects, all without departing from the invention.

DETAILED DESCRIPTION OF PREFERRED EMBODIMENT

Figure 1:
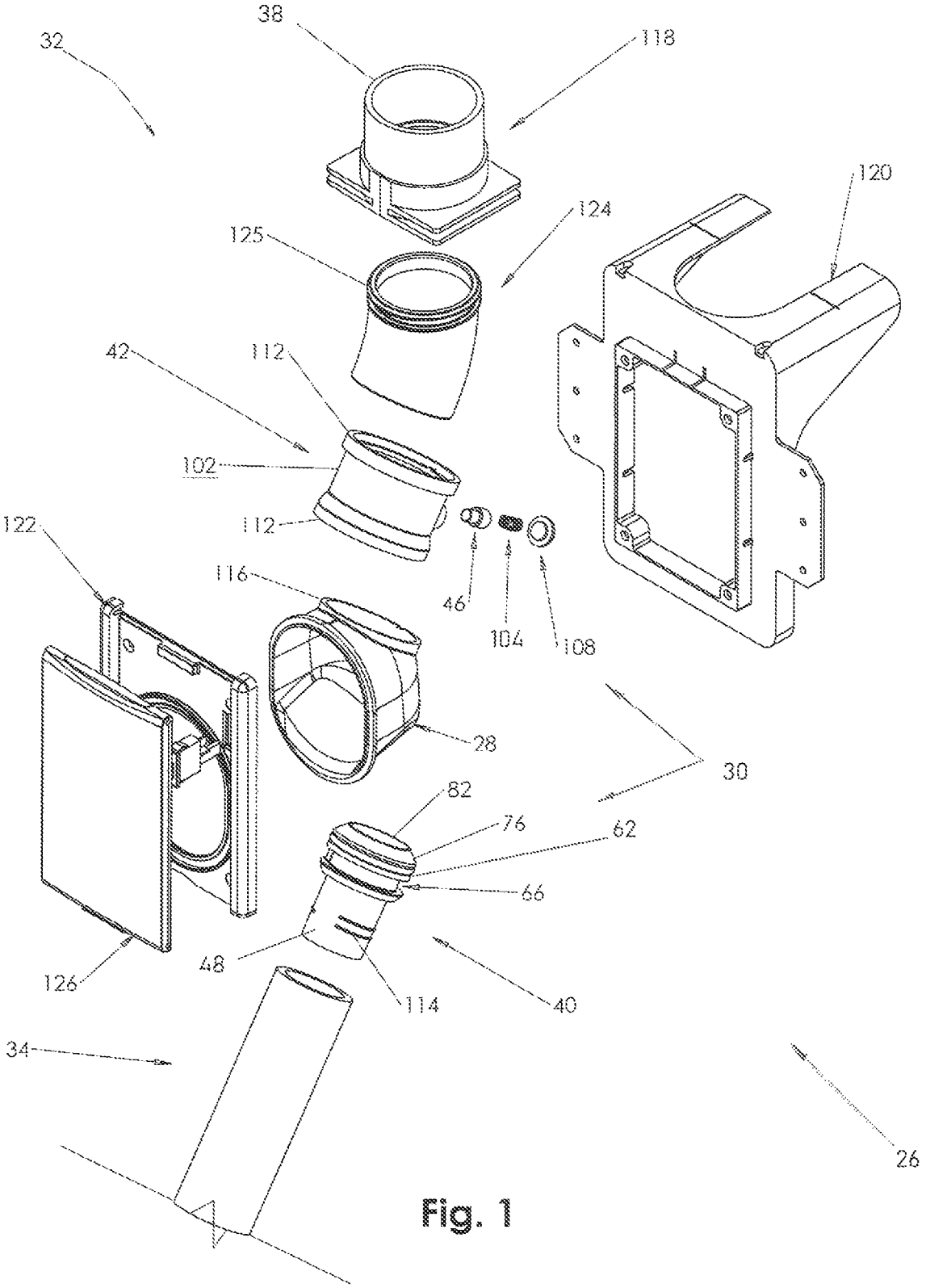
FIG. 1 is a front side exploded perspective view of a hose valve having valve box that incorporates a hose valve sub-assembly that includes an end nozzle and seal-ring.
Figure 2:
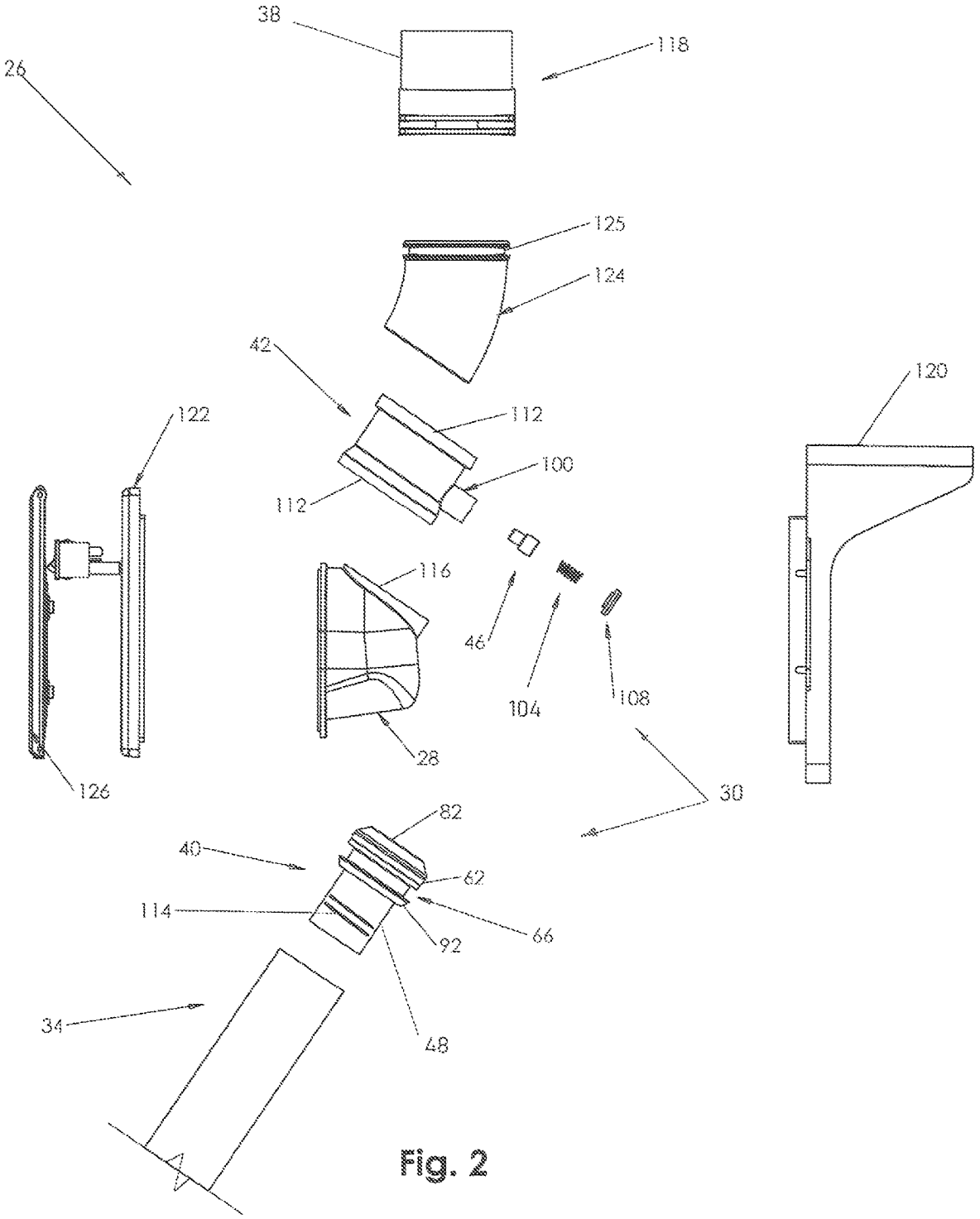
FIG. 2 is a side-elevation exploded view of a hose valve valve box that incorporates a sub-assembly that includes an end nozzle and seal-ring.
Figure 3:
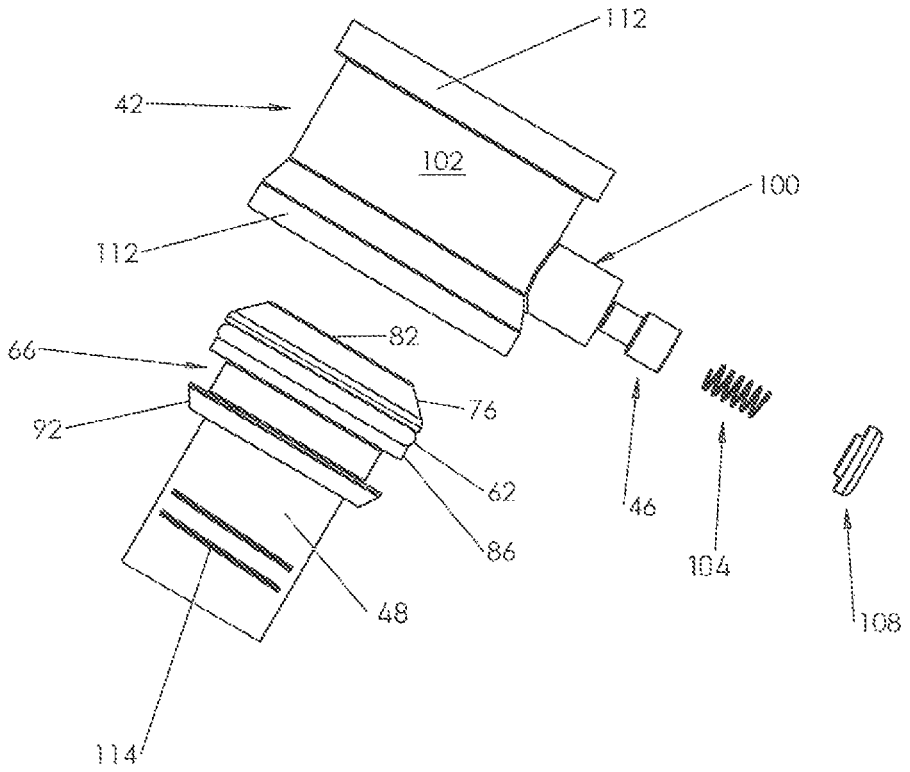
FIG. 3 is a side-elevation exploded view showing a sub-assembly that includes an end nozzle and seal-ring.

FIGS. 1 through 7 show a hose valve having a valve box 28 that incorporates and receives a hose valve sub-assembly 30 designed for use in central vacuum cleaning systems 32 that include a retractable suction hose 34 that retracts through a valve box 28 into a system vacuum pipe 38. The hose valve sub-assembly 30 comprises an end nozzle 40 arranged for attachment with the end of a vacuum suction hose 34. The hose valve sub-assembly 30 also includes a seal-ring 42 arranged to be incorporated and positioned within a valve box 28. Importantly, the seal-ring 42 defines a radially disposed inner surface 44 for receiving and engaging the end nozzle 40, wherein the seal-ring 42 comprises a radially biased pin 46 for locking the end nozzle 40 to a position within the seal-ring 42.

Moreover, the end nozzle 40 comprises a hose engaging end-section 48 for sealed attachment to a suction hose 34, and an opposing locking end 50 configured to engage the inner surface 44 of the seal-ring 42. The end-section 48 comprises a radially outer surface sized to fit within a suction hose 34. The end nozzle 40 further defines an interior surface 54 radially disposed about a longitudinal axis 56, wherein the locking end 50 of the end nozzle 40 further defines an exterior surface with a radially disposed O-ring groove 60 arranged to receive an O-ring 62 for sealing the end nozzle 40 to the inner surface 44 of the seal-ring 42.

Figure 4:
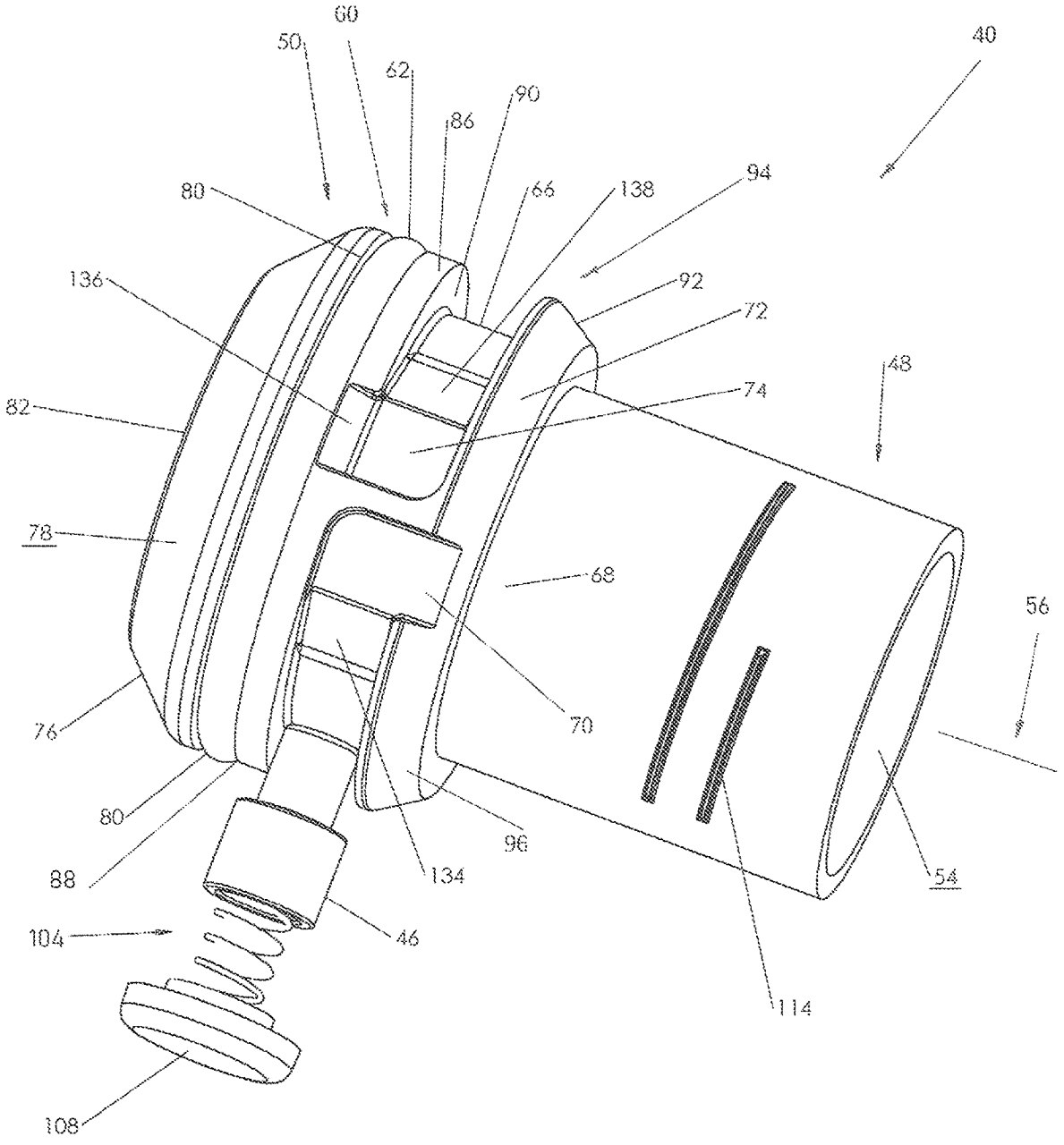
FIG. 4 is a perspective view of an end nozzle.
Figure 5:
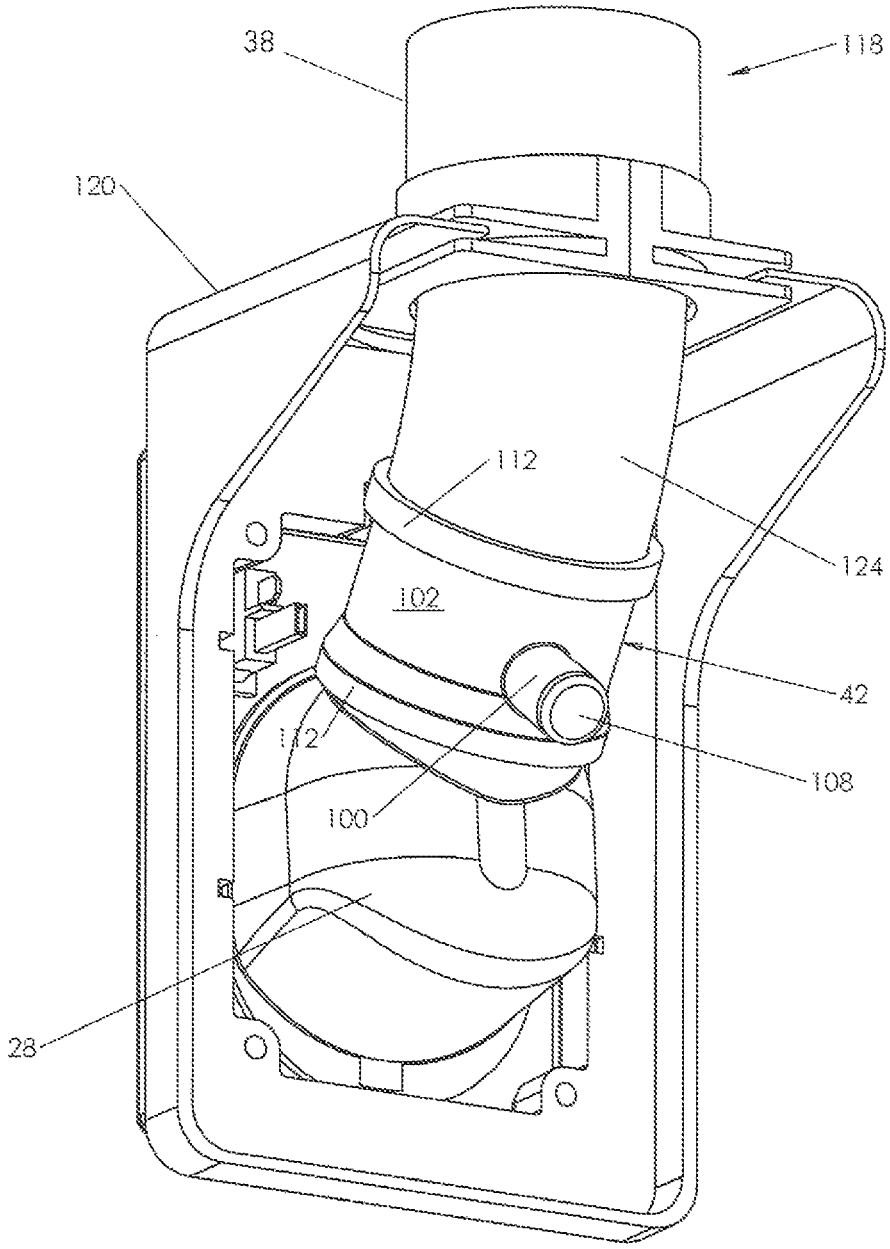
FIG. 5 is a rear perspective view of a hose valve that incorporates a seal-ring.
Figure 6:
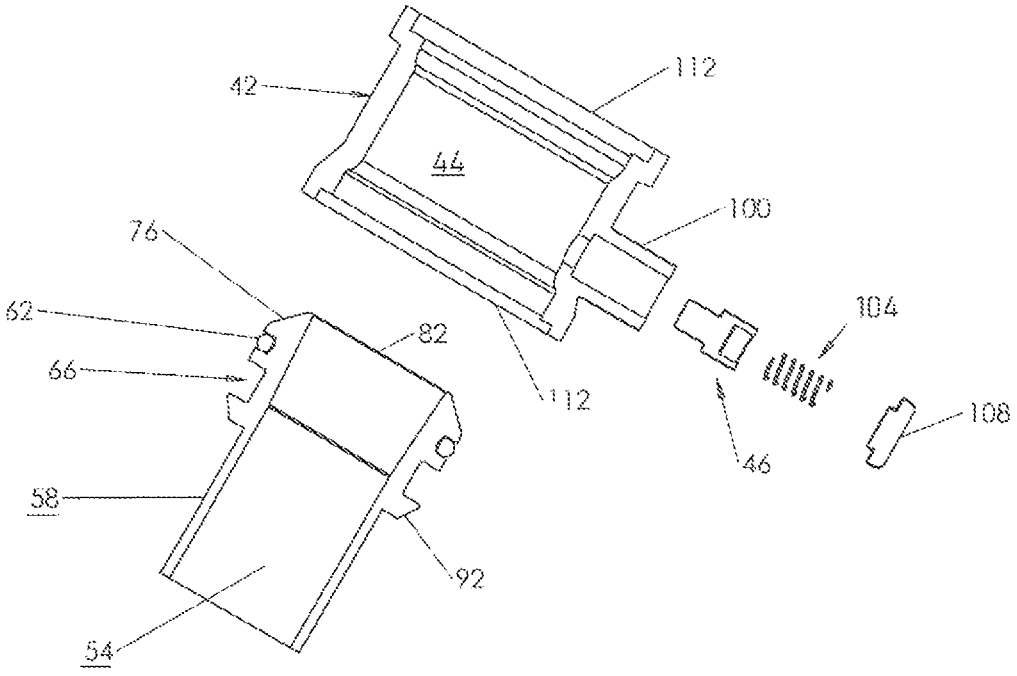
FIG. 6 is a cross-sectional view of an end nozzle in spaced relation to a seal-ring.
Figure 7:
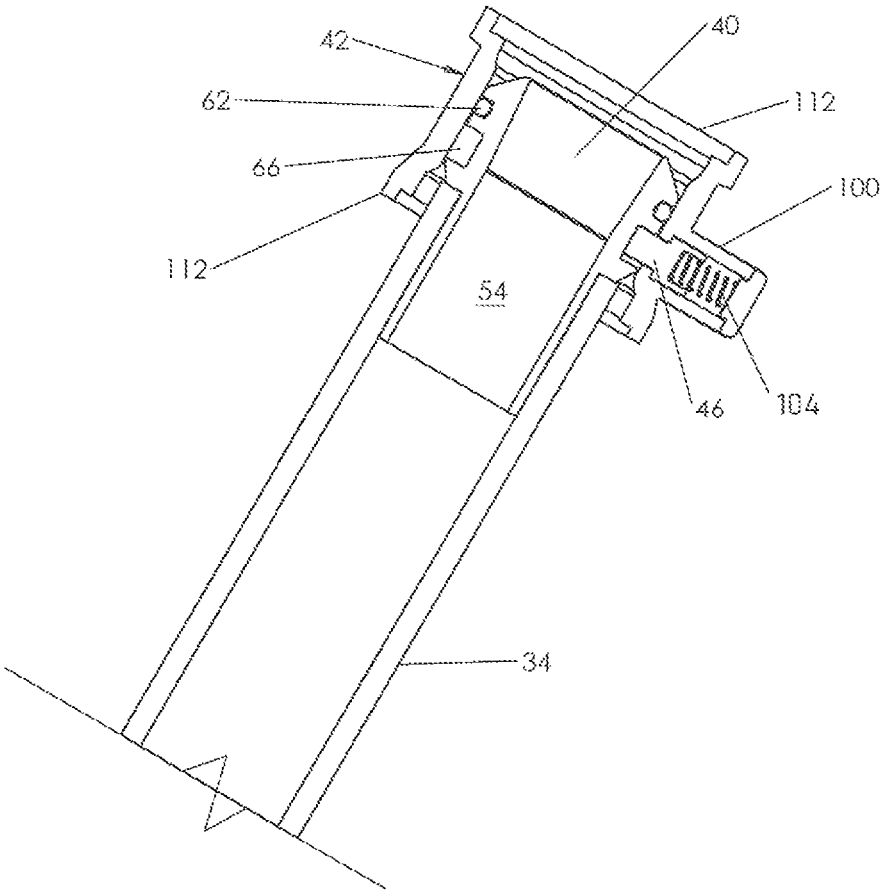
FIG. 7 is a cross-sectional view of an end nozzle sealed within a seal-ring.

Illustrated in FIG. 4, the locking end 50 of the end nozzle 40 further comprises an exterior surface that defines a radially disposed locking track 66 having a first end 68 that defines a first opening 70 adjacent the hose engaging end-section 48. The first opening 70 is arranged to receive and engage the biased pin 46 of the seal-ring 42 when the suction hose 34 is pulled through the system vacuum pipe 38. In addition, the locking track 66 includes an opposing second end 72 that defines a second opening 74 disposed adjacent the O-ring groove 60 and O-ring 62. It should be noted that the second opening 74 is arranged to receive the biased pin 46 of the seal-ring 42 when the vacuum suction hose is inserted through the valve box, into the seal-ring 42. With this configuration, the end nozzle 40 is rotatable from a first disengaged position where the biased pin 46 is adjacent one of the two openings, to a second locked position where the biased pin is in the locking track of the end nozzle 40, between the first opening 70 and second opening 74.

It should be noted that the present invention is arranged to be incorporated into hose valve mechanisms of the type illustrated and described in U.S. Pat. No. 8,479,353 issued to Drivstuen et al in 2013, and to patent application Ser. No. 15/286,431. Accordingly, for this purpose these documents are hereby incorporated by reference. For this purpose, the focus will be primarily on the hose valve sub-assembly 30 described and illustrated in the following, wherein only the major components of a valve box 28, that interact with the hose valve sub-assembly 30, will be examined and discussed considered in detail.

Considering now in more detail, the components of the hose valve sub-assembly 30, the end nozzle 40 includes a radially disposed chamfered end wall 76 that is defined by a radially outer beveled surface 78 that is sloped outward from an O-ring shoulder 80 to an outer edge 82. As illustrated in FIG. 4, the chamfered end wall 76 forms an O-ring shoulder 80 that provides a portion of the O-ring groove 60. The other portion of the O-ring groove 60 is formed by a radially disposed common wall 86 having a first side 88 for retaining an O-ring 62 between the common wall 86 and O-ring shoulder 80 of the chamfered end wall 76. In addition, the common wall 86 includes an opposing second side 90 that defines a portion of the locking track 66. Similarly, a radially disposed chamfered trailing wall 92 defines a shoulder 94 that forms an opposing portion of the locking track 66. In addition, the chamfered trailing wall 92 defines a beveled surface 96 that slopes radially away from the shoulder 94. As will be more fully explained in the following, the chamfered or beveled surfaces provide means for directing the biased pin 46 to retract prior to engaging with the locking track 66. In this way, the end nozzle 40 can be either pulled out of the valve box 28 outward, or inserted into the the valve box 28 when the biased pin 46 is not aligned with either the first or second track opining 70-74. Accordingly, either beveled surface of the end nozzle 40 will cause the biased pin 46 to retract so that the biased pin 46 will align with the locking track 66 and extend into the same to lock the end nozzle 40 within the seal-ring 42.

Importantly, at each end of the locking track 66, an opening is provided: a first track opening 70 provides a path for the end nozzle 40 to be pushed past the biased pin 46, through the chamfered trailing wall 92, into a vacuum pipe 38. Similarly, a second track opening 74 provides a path for the end nozzle to be pulled past the biased pin 46 through a seal-ring 42, out of the valve box 28. For this purpose, the biased pin 46 is disposed through a mount 100 disposed on the radially outer surface 102 of the seal-ring 42. As illustrated in FIGS. 1-5, the biased pin 46 is urged radially inward by a spring 104 disposed within the mount 100 by a cap 108 fixed to the end 110 of the mount 100. With this arrangement, the end nozzle 40 can be moved from a position, in the system vacuum pipe 38, to a locked position where the biased pin 46 retracts as it moves over the chamfered trailing wall 92 into the locking track 66, between the first track end 68 and the second track end 72. Then for storing the vacuum suction hose 34 within the system vacuum pipe 38, the user can rotate the hose/end nozzle 40 to align with the biased pin 46 with the first track opening 70 allowing the end nozzle 40 to be unrestrained by the biased pin 46 so that the vacuum suction 34 hose is free to move into the vacuum pipe 38. In the present invention, the seal-ring 42 is disposed between the valve box 28 and the vacuum pipe 38 and is fixed by opposing connection rings 112 that attach respectively to the valve box lip 116, and to a transition pipe 124.

Moreover, the vacuum suction hose 34 is attached to the end nozzle 40 by helical raised threads 114 formed on the radially outer surface of end-section 48 of the end nozzle 40 as illustrated in FIG. 4. With this arrangement, and end nozzle 40 can be fixed to a vacuum hose by rotating engagement.

Turning again to FIG. 4, the second track opening 74 of the end nozzle 40 further comprises an opening ramp 136 that slopes radially outward, as an extension to the second track opening 74, to the outer most portion of the common wall 86 thereby providing a sloped surface to improve the performance of the biased pin 46 retracting as the end nozzle 40 is pulled out of the seal-ring 42 to remove the suction hose 34 from the hose valve 26.

Similarly, each end of the locking track 66 includes a sloping transition surface, first track ramp 134 that slopes from the locking track 66 to the first track opening 70, and a second track ramp 138 that slopes from the locking track 66 to second track opening 74. This arrangement improves the performance of the biased pin 46 retracting as the end nozzle is rotated so that the biased pin 46 aligns with either the first or second track opening 70-74.

In the drawings and specifications there have been set forth preferred embodiments of the invention and although specific terms are employed, they are used in a generic and descriptive sense only and not for purposes of limitation. The design of the hose valve sub-assembly depicted in this invention combine several functions, that of sealing, restraining and wear reduction, into one device or mechanism. Separate devices or mechanisms could be used for each function. Other devices or mechanisms could be used to achieve the functions and results.

In addition, whereas the drawings and specifications relate to central vacuum cleaning systems for a home or building, the application is not limited to this industry alone but to any industry or operation where a vacuum system is used.

Finally, in the present invention, the hose valve sub-assembly 30 is adapted to to be incorporated into hose valves that include many common components including slide fittings 118, mounting assemblies 120, face plates 122 with sealing doors 126 that operate on-off switches 128.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

What is claimed is:

1. A hose valve sub-assembly for central vacuum cleaning systems having a retractable suction hose that retracts through a valve box into a system vacuum pipe, the hose valve sub-assembly comprising:

an end nozzle arranged for attachment with the end of a vacuum suction hose;

a seal-ring arranged for attachment to a valve box, the seal-ring defining a radially disposed inner surface for receiving and engaging the end nozzle, wherein the seal-ring comprises a radially biased pin extending through the inner surface for locking the end nozzle to a position within the seal-ring;

the end nozzle comprising a hose engaging end-section for sealed attachment to a suction hose, and an opposing locking end configured to engage the inner surface of the seal-ring, the locking end of the end nozzle having a radially disposed O-ring groove arranged to receive an O-ring for sealing the end nozzle to the inner surface of the seal-ring;

the locking end further comprising a radially disposed locking track disposed for engagement with the biased pin to lock the end nozzle within the seal-ring, the locking track having a first track end defining a first track opening disposed adjacent the end-section of the end nozzle, arranged to disengage the locking pin from the locking track to enable the end nozzle to retract into the system vacuum pipe, and the locking track having an opposing second track end defining a second track opening, disposed adjacent the O-ring, the second track opening arranged to disengage the locking pin from the locking track to enable the end nozzle to be pulled out of the hose valve; and wherein the end nozzle is rotatable from a first unlocked position where the biased pin is engaged with a track opening, to a second locked position where the biased pin is in the locking track of the end nozzle, between the first track opening and second track opening to secure the end nozzle within the seal ring.

2. A hose valve sub-assembly as recited in claim 1 wherein the end nozzle comprises a chamfered trailing wall with the beveled surface sloping radially inward from adjacent the locking track toward the end-section of the end nozzle.

3. A hose valve sub-assembly as recited in claim 1 wherein the end nozzle comprises a chamfered end wall with the beveled surface sloping radially inward from adjacent the 0-ring to an outer edge of the end nozzle.

4. A hose valve sub-assembly as recited in claim 3 wherein the end nozzle comprises a chamfered trailing wall with the beveled surface sloping radially inward from adjacent the locking track toward the end-section of the end nozzle.

5. A hose valve sub-assembly as recited in claim 4 wherein a portion of the locking track, of the end nozzle, forms a track ramp that leads radially outward from the locking track to the second track opening.

6. A hose valve sub-assembly as recited in claim 5 wherein a portion of the locking track, of the end nozzle, forms a track ramp that leads radially outward from the locking track to the second track opening.

7. A hose valve sub-assembly as recited in claim 6 wherein the second track opening of the end nozzle 40 further comprises an opening ramp that slopes radially outward forming an extension to the second track opening.

8. A hose valve sub-assembly as recited in claim 1 wherein the second track opening of the end nozzle 40 further comprises an opening ramp that slopes radially outward forming an extension to the second track opening.

9. A method for making hose valve sub-assembly for central vacuum cleaning systems having retractable suction hoses that retract into a system vacuum pipe, the method comprising the steps:

forming an end nozzle arranged for attachment with the end of a vacuum suction hose;

forming an seal-ring arranged for attachment to a valve box, the seal-ring defining a radially disposed inner surface for receiving and engaging the end nozzle, wherein the seal-ring comprises a radially biased pin extending through the inner surface for locking the end nozzle to a position within the seal-ring;

arranging the end nozzle to comprise a hose engaging end-section for sealed attachment to a suction hose, and an opposing locking end configured to engage the inner surface of the seal-ring, the locking end of the end nozzle having a radially disposed O-ring groove arranged to receive an O-ring for sealing the end nozzle to the inner surface of the seal-ring;

arranging the locking end to further comprise a radially disposed locking track disposed for engagement with the biased pin to lock the end nozzle within the seal-ring, the locking track having a first track end defining a first track opening disposed adjacent the end-section of the end nozzle, arranged to disengage the locking pin from the locking track to enable the end nozzle to retract into the system vacuum pipe, and the locking track having an opposing second track end defining a second track opening, disposed adjacent the O-ring, the second track opening arranged to disengage the locking pin from the locking track to enable the end nozzle to be pulled out of the hose valve; and wherein the end nozzle is rotatable from a first unlocked position where the biased pin is engaged with a track opening, to a second locked position where the biased pin is in the locking track of the end nozzle, between the first track opening and second track opening to secure the end nozzle within the seal ring.

10. A method for making a hose valve sub-assembly as recited in claim 9 wherein the end nozzle is formed to define a chamfered trailing wall with the beveled surface sloping radially inward from adjacent the locking track toward the end-section of the end nozzle.

11. A method for making a hose valve sub-assembly as recited in claim 9 wherein the end nozzle is formed to define a chamfered end wall with the beveled surface sloping radially inward from adjacent the 0-ring to an outer edge of the end nozzle.

12. A method for making a hose valve sub-assembly as recited in claim 11 wherein the end nozzle is formed to define a chamfered trailing wall with the beveled surface sloping radially inward from adjacent the locking track toward the end-section of the end nozzle.

13. A method for making a hose valve sub-assembly as recited in claim 12 wherein a portion of the locking track, of the end nozzle is formed to provide a track ramp that leads radially outward from the locking track to the second track opening.

14. A method for making a hose valve sub-assembly as recited in claim 13 wherein a portion of the locking track, of the end nozzle is formed to provide a track ramp that leads radially outward from the locking track to the second track opening.

15. A method for making a hose valve sub-assembly as recited in claim 14 wherein the second track opening of the end nozzle 40 is formed to define a opening ramp that slopes radially outward forming an extension to the second track opening.

16. A method for making a hose valve sub-assembly as recited in claim 9 wherein the second track opening of the end nozzle 40 is formed to further comprise an opening ramp that slopes radially outward forming an extension to the second track opening.

17. A hose valve sub-assembly for central vacuum cleaning systems having a retractable suction hose that retracts through a valve box into a system vacuum pipe, the hose valve sub-assembly comprising:

an end nozzle arranged for attachment with the end of a vacuum suction hose;

a seal-ring arranged for attachment to a valve box, the seal-ring defining a radially disposed inner surface for receiving and engaging the end nozzle, wherein the seal-ring comprises a radially biased pin extending through the inner surface for locking the end nozzle to a position within the seal-ring;

the end nozzle comprising a hose engaging end-section for sealed attachment to a suction hose, and an opposing locking end configured to engage the inner surface of the seal-ring, the locking end of the end nozzle having a radially disposed O-ring groove arranged to receive an O-ring for sealing the end nozzle to the inner surface of the seal-ring;

the locking end further comprising a radially disposed locking track disposed for engagement with the biased pin to lock the end nozzle within the seal-ring, the locking track having a first track end defining a first track opening disposed adjacent the end-section of the end nozzle, arranged to disengage the locking pin from the locking track to enable the end nozzle to retract into the system vacuum pipe, and the locking track having an opposing second track end defining a second track opening, disposed adjacent the O-ring, the second track opening arranged to disengage the locking pin from the locking track to enable the end nozzle to be pulled out of the hose valve;

the end nozzle further comprising a chamfered trailing wall with the beveled surface sloping radially inward from adjacent the locking track toward the end-section of the end nozzle;

the end nozzle further comprising a chamfered end wall with the beveled surface sloping radially inward from adjacent the 0-ring to an outer edge of the end nozzle; and wherein the end nozzle is rotatable from a first unlocked position where the biased pin is engaged with a track opening, to a second locked position where the biased pin is in the locking track of the end nozzle, between the first track opening and second track opening to secure the end nozzle within the seal ring.

18. A hose valve sub-assembly as recited in claim 17 wherein the end nozzle comprises a chamfered trailing wall with the beveled surface sloping radially inward from adjacent the locking track toward the end-section of the end nozzle.

19. A hose valve sub-assembly as recited in claim 18 wherein a portion of the locking track, of the end nozzle, forms a track ramp that leads radially outward from the locking track to the second track opening.

* * * * *